US006810950B1

(12) United States Patent
Manze, III

(10) Patent No.: US 6,810,950 B1
(45) Date of Patent: Nov. 2, 2004

(54) RADIATOR COVER

(76) Inventor: Louis F. Manze, III, 13432 Mortons Corners Rd., Springville, NY (US) 14141

( * ) Notice: Subject to any disclaimer, the term of this patent is extended or adjusted under 35 U.S.C. 154(b) by 0 days.

(21) Appl. No.: 10/661,060

(22) Filed: Sep. 13, 2003

(51) Int. Cl.[7] ..... F28D 1/00
(52) U.S. Cl. ..... 165/149; 165/98; 180/68.6
(58) Field of Search ..... 165/149, 98, 99, 165/78; 180/68.4, 68.6

(56) References Cited

U.S. PATENT DOCUMENTS 1,399,859 A * 12/1921 Garver ..... 180/68.4
1,496,661 A * 6/1924 Dreier ..... 180/68.6
1,877,324 A * 9/1932 Ihde ..... 180/68.6
2,966,339 A * 12/1960 Morgan ..... 55/490.2
3,863,728 A * 2/1975 Mittendorf ..... 180/68.6
3,987,863 A * 10/1976 Mittendorf et al. ..... 180/68.6
4,066,119 A * 1/1978 Stedman ..... 165/41
4,125,147 A * 11/1978 Bailey ..... 165/95
4,140,177 A * 2/1979 Ivie, Sr. ..... 165/134.1
4,178,034 A * 12/1979 Mittendorf ..... 296/91
4,236,592 A * 12/1980 Ziegler ..... 180/68.6
4,339,014 A * 7/1982 Berth et al. ..... 180/68.1

FOREIGN PATENT DOCUMENTS

DE 3629880 * 3/1988 ..... 180/68.6

* cited by examiner

*Primary Examiner*—Terrell McKinnon

(57) ABSTRACT

An easily removable protective radiator cover assembly having easily replaceable filtering material for protecting an air-cooled radiator. To attain this, a frame hanging on an air-intake radiator side receives a slidably mounted, filtering material accommodating screen case. In an embodiment, a hanging frame having a horizontal bottom section extending across the radiator and a pair of vertical, side sections extending from each end of the bottom section; a filtering-material-accommodating screen case, slidably mounted within the frame and resting upon the bottom section; and a pair of frame extensions affixed to and extending from the frame to the radiator top.

4 Claims, 3 Drawing Sheets

RADIATOR COVER

BACKGROUND OF THE INVENTION

1. Field of the Invention

The present invention relates to a radiator cover for use in connection with an air-cooled radiator. The radiator cover has particular utility in connection with protecting a radiator.

2. Description of the Related Art

Radiator covers are desirable for keeping a radiator clean and for shielding the radiator from debris.

The use of radiator protectors is known in the prior art. For example, U.S. Pat. No. 2,966,339 to Morgan discloses a radiator protector device that provides corrosion protection to an air-cooled radiator.

U.S. Pat. No. 6,131,681 to Nelson et al. discloses a winter front assembly that prevents the over-cooling of a vehicle's cooling system. However, the Nelson et al. '681 patent does not include a frame configured to hang from a radiator, nor does the Nelson et al. '681 patent include a screen case configured to be slidably mounted within the frame as claimed.

Consequently, the Nelson et al. '681 patent does not provide the ease of removal afforded by the features presented in the instant application.

Similarly, U.S. Pat. No. 3,344,854 to Boyajian discloses an anticlog device for engine radiators that prevents the clogging of heat exchangers by foreign particles entrained in the cooling medium by providing a movable endless belt screen around the heat exchanger that covers the inlet and the outlet of the cooling medium's path, thus also forming a self-cleaning device. However, the Boyajian '854 patent does not include a frame configured to hang from a radiator, nor does the Boyajian '854 patent include a screen case configured to be slidably mounted within the frame as claimed. Consequently, the Boyajian '854 patent does not provide the ease of removal afforded by the features presented in the instant application.

U.S. Pat. No. 2,854,086 to Schmidt discloses a protective screen device for automobile engines that is arranged between the grill and the engine to prevent insects from passing onto the engine. However, the Schmidt '086 patent does not include a frame configured to hang from a radiator, nor does the Schmidt '086 patent include a screen case slidably mounted within the frame as claimed.

U.S. Pat. No. 4,836,598 to Mastin discloses an insect screen attachment apparatus for vehicles that attaches to a bug shield. However, the Mastin '598 patent does not include a frame configured to hang from a radiator, nor does the Mastin '598 patent include a screen case slidably mounted within the frame as claimed.

U.S. Pat. No. 4,236,592 to Ziegler discloses a protective structure for vehicles that protects both the radiator and the windshield of a vehicle and is arranged on the front-most portion of a car, in front of any grill. However, the Ziegler '592 patent does not include a frame configured to hang from a radiator, nor does the Ziegler '592 patent include a screen case slidably mounted within the frame as claimed.

U.S. Pat. No. 4,125,147 to Bailey discloses a method for continuously maintaining a radiator free of debris, where the method comprises rotating an endless perforated belt about the radiator such that both sides of the belt are exposed to both the front and the back of the radiator during such rotation. However, the Bailey '147 patent does not include a frame configured to hang from a radiator, nor does the Bailey '147 patent include a screen case slidably mounted within the frame as claimed.

U.S. Pat. No. 2,778,439 to Pfingsten discloses a combination radiator screen and insect deflector for windshields that is also arranged on the front-most portion of a car. However, the Pfingsten '439 patent does not include a frame configured to hang from a radiator, nor does the Pfingsten '439 patent include a screen case slidably mounted within the frame as claimed.

Lastly, U.S. Pat. No. 2,263,357 to Hanson discloses a screen for automobile radiators that includes a predetermined indication of lines on which to fold the screen such that the screen will conform to any one of a number of pre-determined standard automobile radiator sizes. However, the Hanson '357 patent does not include a frame configured to hang from a radiator, nor does the Hanson '357 patent include a screen case slidably mounted within the frame as claimed.

While the above-described devices fulfill their respective, particular objectives and requirements, the aforementioned patents do not describe a radiator cover that allows ease of removal for not only the screen case but also for the radiator cover frame within which the screen case is slidably mounted. The Morgan '339 patent makes no provision for including a frame configured to hang from a radiator, nor does Morgan '339 include a bottom frame section extending across the radiator as claimed. Consequently, Morgan '339 does not provide the ease of removal or the stability afforded by the features presented in the instant application.

Therefore, a need exists for a new and improved radiator cover having a frame which can be easily removed, and having a screen case slidably mounted within the frame that may also be easily removed. In this regard, the present invention substantially fulfills this need. In this respect, the radiator cover according to the present invention substantially departs from the conventional concepts and designs of the prior art, and in doing so provides an apparatus primarily developed for the purpose of removably protecting a radiator.

SUMMARY OF THE INVENTION

In view of the foregoing disadvantages inherent in the known types of radiator protectors now present in the prior art, the present invention provides an improved radiator cover, and overcomes the above-mentioned disadvantages and drawbacks of the prior art. As such, the general purpose of the present invention, which will be described subsequently in greater detail, is to provide a new and improved radiator cover and method of protecting a radiator which has all the advantages of the prior art mentioned heretofore and many novel features that result in a radiator cover which is not anticipated, rendered obvious, suggested, or even implied by the prior art, either alone or in any combination thereof.

To attain this, the present radiator cover assembly invention essentially comprises a hanging frame arranged on an air-intake side of the radiator, where the frame includes a horizontal bottom section and a pair of vertical side sections, where the bottom section extends across the radiator and the pair of side sections extend one from each end of the bottom section; and a screen case, where the screen case is slidably mounted within the frame, and where the screen case is configured to accommodate filtering material.

In an embodiment, the present radiator cover assembly invention comprises a hanging frame arranged on an air-intake side of the radiator, where the frame includes a horizontal bottom section and a pair of vertical side sections, where the bottom section extends across the radiator and the pair of side sections extend one from each end of the bottom section, and where the side sections each include a u-shaped channel; and a rectangular screen case, where the screen case is slidably mounted within the frame, coming to rest upon the bottom section, and where the screen case is configured to accommodate filtering material; and a pair of frame extensions, where the frame extensions are affixed to the frame and extend along the air-intake side of the radiator and to the top of the radiator such that the frame hangs from the radiator using the frame extensions.

Finally, the present invention comprises a method of protecting a radiator including placing filtering, material with a screen case; sliding the screen case into a frame, where the frame includes a pair of frame extensions where the frame extensions are movably coupled to a pair of bracket tabs; arranging the screen case on an air-intake side of a radiator such that the frame extensions and bracket tabs are arranged at the top of the radiator; and moving the bracket tabs with respect to the frame extensions so that the frame hangs from the radiator.

There has thus been outlined, rather broadly, the more important features of the invention in order that the detailed description thereof that follows may be better understood and in order that the present contribution to the art may be better appreciated.

The invention may also include a bracket adjuster that may vary the distance between the frame and the air outlet side of the radiator. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved radiator cover that has all of the advantages of the prior art radiator protectors and none of the disadvantages.

It is another object of the present invention to provide a new and improved radiator cover that may be easily and efficiently manufactured and marketed.

An even further object of the present invention is to provide a new and improved radiator cover that has a low cost of manufacture with regard to both materials and labor, and which accordingly is then susceptible of low prices of sale to the consuming public, thereby making such radiator cover economically available to the buying public.

Still another object of the present invention is to provide a new radiator cover that provides in the apparatuses and methods of the prior art some of the advantages thereof, while simultaneously overcoming some of the disadvantages normally associated therewith.

Even still another object of the present invention is to provide a radiator cover for restricting airflow across the radiator.

Still yet another object of the present invention is to provide a radiator cover that can be easily removed from the radiator. Another object of the invention is to provide an improved method of replacing filtering material.

Lastly, it is an object of the present invention to provide a new and improved method of protecting a radiator.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

Figure 1:
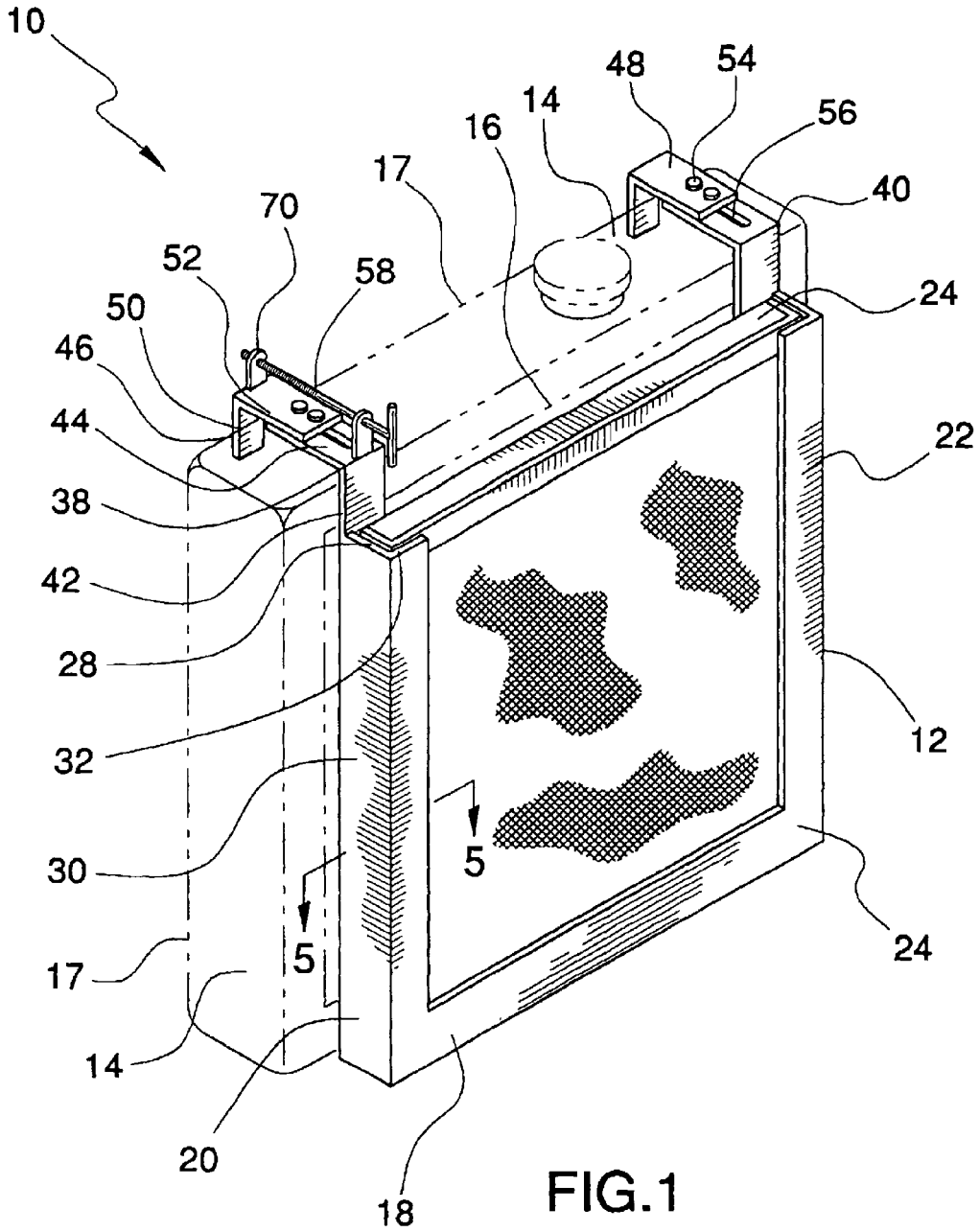
FIG. 1 is an oblique view of an embodiment of the radiator cover assembly of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

Referring now to the drawings, and particularly to FIGS. 1–5, a preferred embodiment of the radiator cover of the present invention is shown and generally designated by the reference numeral 10.

In FIG. 1, a new and improved radiator cover 10 of the present invention for protecting a radiator is illustrated and will be described. More particularly, the radiator cover assembly 10 includes a frame 12. Such frame is to be arranged in front of a radiator such that the majority of the surface area, of an air-intake side of the radiator is circumscribed. Further, the frame may be of a size such that the entirety of the surface area of an air-intake side of the radiator is circumscribed. The frame is to be constructed of a strong, weatherproof, heatproof material. In the preferred embodiment, the frame is constructed from metal. However, other materials may be used. In particular, composite materials may be desirable for their unique properties.

The frame 12 comprises a bottom frame section 18. The bottom frame section extends across the length of the radiator and is substantially horizontal. The bottom frame section is arranged at or rear the bottom of the radiator. Extending from the ends of the bottom frame section is a pair of opposed, parallel side sections. Left frame side section 22 is shown extending from bottom frame section 18, as is right frame side section 24. Screen case 24 is slidably mounted into the frame 12, held within guides defined by the side sections 22 and 24.

Extending from the frame 12 toward the top of the radiator is a pair of frame extensions, left frame extension 38 and right frame extension 40. The frame extensions are fixably attached to the frame. The frame extensions may be made from the same metal as the frame, but are not necessarily of the same metal. The frame extensions may be integral with the frame, created at the time the remainder of the frame is made. Alternately, the frame extensions may be fixed attached to the frame using some type of mounting means. Such mounting means include, but are not limited to, welding, riveting, and using screw fasteners.

Each frame extension includes at least 2 sections. In the preferred embodiment, the at least 2 sections are of the same material, but this is not necessarily the case. Shown in FIG. 1 are air-intake side frame extension section 42 and radiator top frame extension section 44. The air-intake section 42 extends from the frame to the top of the radiator, traversing at least a portion of that part of the radiator arranged at the top of the radiator through which no air may flow. The radiator top section 44 extends from the air-intake side of the radiator to at least the midpoint of the top of the radiator. The radiator top section includes a slot 56 therethrough, extending along radiator top section lengthwise. Each slot 56 is configured to accommodate at least one post 54. Such post 54 is arranged in bracket tabs, which will be described below.

Movably coupled to the frame extension, so as to accommodate radiators of varying widths is a pair of bracket tabs. Left bracket tab 46 and right bracket tab 48 are shown in FIG. 1. As above, each bracket tab comprises at least 2 sections. In the preferred embodiment, the at least 2 sections are of the same material, but this is not necessarily the case. Shown in FIG. 1 are air-outlet side bracket tab section 50 and radiator top bracket tab section 52. The air-outlet section 50 extends from the air-outlet side of the radiator to the top of the radiator, traversing at least a portion of that part of the radiator arranged at the top of the radiator through which no air may flow. The radiator top section 52 extends above the top of the radiator from the air-outlet side of the radiator to beyond the midpoint of the top of the radiator. The radiator top section 52 includes at least one post 54. Post 54 is configured to extend downward through the slot 56. In this way, left and right mounting brackets 34 and 36 are formed from components. Namely, bracket tabs and frame extensions are coupled together to form mounting brackets.

In order to install the radiator cover assembly, it is necessary to create a space between the bracket tab and the frame extension that exceeds the width of the radiator. When sufficient space exists between the bracket tab and the frame extension, the radiator cover assembly may be placed on the radiator such that the frame 12 hangs from the radiator supported by the mounting brackets formed by the bracket tabs and frame extensions. It is desirable to secure the frame 12 to the radiator 14. Consequently, in the preferred embodiment a bracket adjuster 58 extends across the width of the radiator. The bracket adjuster is coupled to the bracket tab and frame extension via an adjuster mount 70. In the preferred embodiment, rotating the threaded bracket adjuster varies the distance between the bracket tab and the frame extension. The adjuster mount is fixably coupled to the left bracket tab and frame extension in the preferred embodiment. In an embodiment, an adjuster mount may also be used on the right bracket tab and frame extension.

Figure 2:
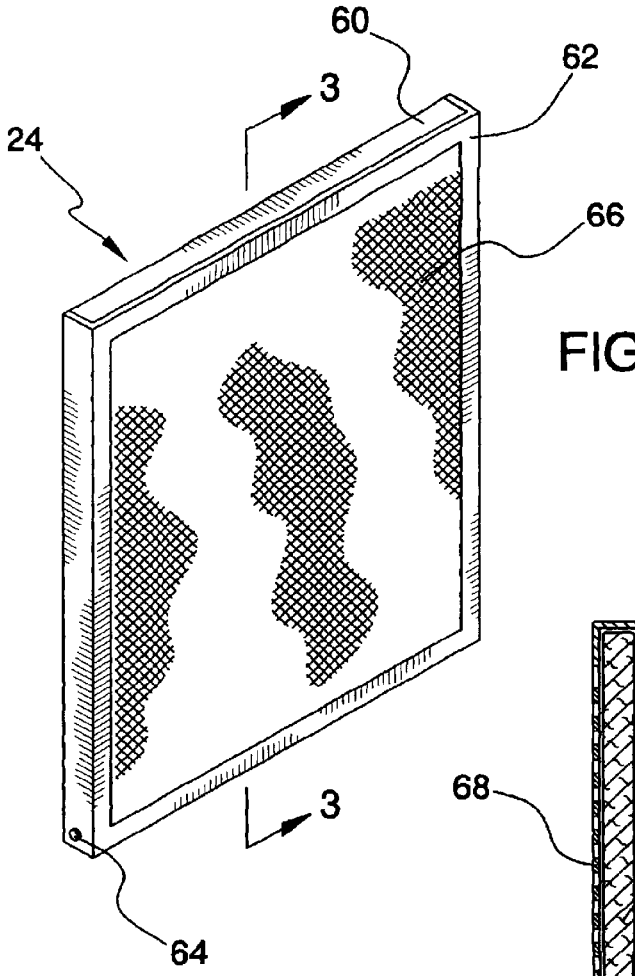
FIG. 2 is an oblique view of an embodiment of the screen case of the present invention.

Illustrated in FIG. 2 is the screen case 24 removed from the frame. The screen case 24 comprises a screen case front, which reciprocates with a screen case back to form a rectangle having a space within for filtering material 26. In the preferred embodiment, the screen case front 62 is coupled to the screen case back 60 using the pivot 64. The screen case front includes a front screen 66, and the screen case back includes a back screen 68. In the preferred embodiment, the front screen 66 has a finer mesh than that of the back screen 68. However, the meshes may be the same, or the back screen may have a finer mesh in alternate embodiments.

Figure 3:
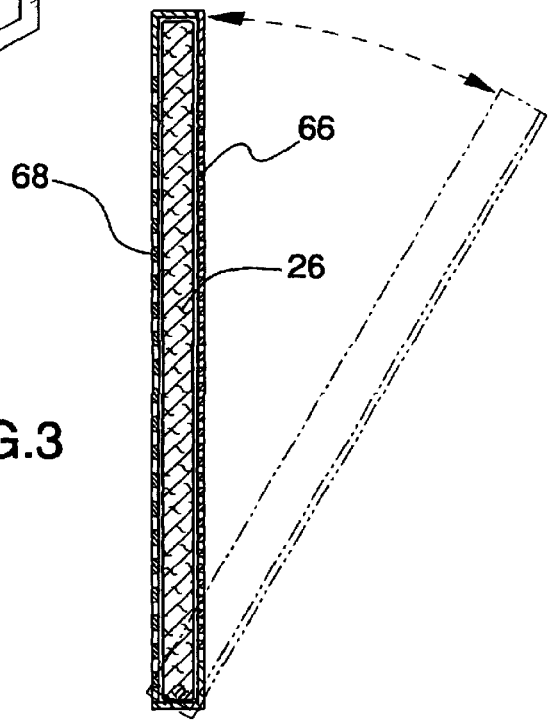
FIG. 3 is a cross-section view of an embodiment of the screen case of the present invention. The cross-section is taken on line 3 of FIG. 2.

Filtering; material 26 is a fibrous material that may act as a filter for insects and/or road debris. The filter may be one of a number of materials. Further, filters in a number of densities may be used such that airflow restriction may be varied according to season and expected outside temperature. Furthermore, the filter may include materials which may be more susceptible to corrosion than the radiator itself, thus providing additional protection. In addition to preferred, commercially available filters, loose filtering material may be used. In the preferred embodiment, a coarse fiberglass media filter is used. FIG. 3 is a cross section of FIG. 2 taken on line 3, which indicates the opening of the screen case 24 such that filtering material may be inserted into or removed from the screen case 24.

Figure 4:
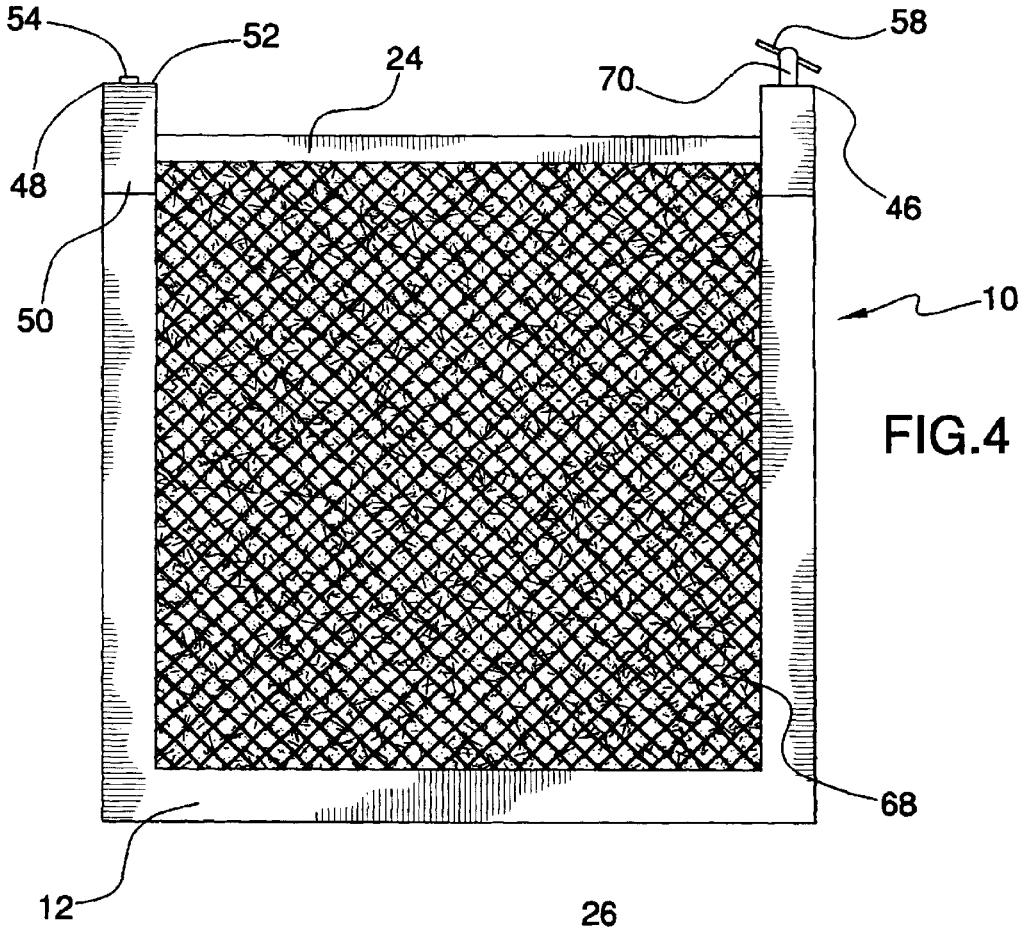
FIG. 4 is a back view of an embodiment of the radiator cover assembly of the present invention.

A back view of the radiator cover assembly 10 is shown in FIG. 4. In this view, we see the back screen 68, which is of a coarser grain than the front screen in the preferred embodiment. Also, more clearly illustrated is the air outlet side bracket tab section 50. It is shown to extend downward from the top bracket tab section 52 toward the bottom of the radiator, extending past a top surface of the screen case.

Figure 5:
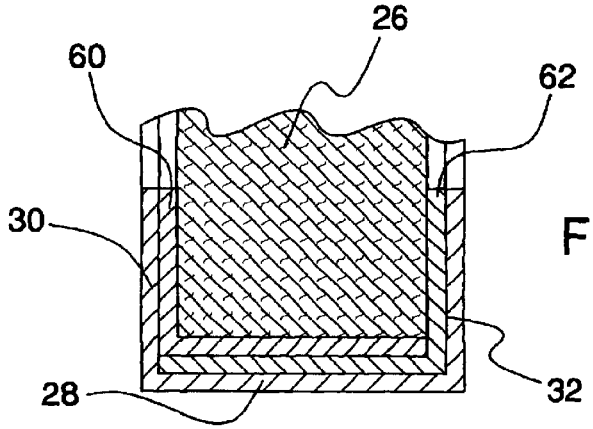
FIG. 5 is a cross-section view of an embodiment of the frame of the present invention. The cross-section is taken on line 5 of FIG. 1.

Turning to FIG. 5, a cross section of the frame is shown. The cross section is taken on line 5 shown in FIG. 1. More clearly illustrated are the components found in each side section channel. In particular, a base portion 28 extends across the bottom of the channel. When a screen case is placed into the frame, such base portion is arranged adjacent the screen case front 62. Channel left side portion 30 and right side portion 42 are substantially parallel and perpendicular to the base portion 28. Screen case back 60 is adjacent side portion 30, and screen case front 62 is adjacent side portion 32.

In use, it can now be understood that the radiator cover assembly 10 protects an automobile's radiator and or transmission coils from bugs, road tar, stones, road salts, and any other airborne debris or airborne corrosive agent that may come in contact with the radiator in the absence of the radiator, cover assembly. The radiator cover assembly 10 may be easily adjusted to accommodate a wide variety of radiators by varying the distance between the bracket tabs and frame extensions using bracket adjuster 58. Once this distance is greater than the width of the radiator, the frame may be hung from the radiator and the bracket adjuster once again used to snug the frame to the radiator. Once the frame is hung, or mounted, to the radiator in this fashion, the screen case is easily inserted into and removed from the frame by sliding the screen, case along the channel shaped side portions. The screen case comprises a case back 60 hinged to a case front 62, where the case back and case front are easily opened to insert or remove filtering material.

While a preferred embodiment of the radiator cover has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitably sturdy material such as mold-injected plastic may be used for the frame and/or screen case instead of the metal described. Also, other methods of coupling the screen case front and screen case back may be used instead of the pivot describe. And although protecting an automotive radiator has been described, it should be appreciated that the radiator cover herein described is also suitable for tractor-trailer radiator filtration, computer power supply cooling fan air intake, and industrial compressed air oil cooling systems. Furthermore, a wide variety of filtering materials may be used instead of the fiberglass described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A radiator cover assembly comprising:

a frame, wherein the frame is configured to hang from an air-cooled radiator such that the frame is arranged on an air-intake side of the radiator, wherein the frame comprises a substantially horizontal bottom section extending across the radiator and a pair of substantially vertical opposed side sections extending from respective ends of the bottom section, wherein each side section comprises a substantially u-shaped channel; and a screen case, wherein the screen case is configured to be slidably mounted within the frame such that the screen case rests upon the frame's bottom section, wherein the screen case is substantially rectangular, and wherein the screen case is configured to accommodate filtering material; and a pair of frame extensions, wherein the frame extensions are fixedly attached to the frame, and wherein the frame extensions extend along the air-intake side of the radiator to a top of the radiator such that the frame hangs from the radiator using the frame extensions, and a pair of bracket tabs, wherein the bracket tabs extend from the air-outlet side of the radiator to a top of the radiator such that they may be coupled with the frame extensions and such that the frame is hung from the radiator using the frame extensions coupled to the bracket tabs;

wherein the screen case comprises a pivot point, and wherein the case front and case back are coupled together at the pivot point.

2. A radiator cover assembly comprising:

a frame, wherein the frame is configured to hang from an air-cooled radiator such that the frame is arranged on an air-intake side of the radiator, and wherein the frame comprises a substantially horizontal bottom section extending across the radiator and a pair of substantially vertical opposed side sections extending from respective ends of the bottom section; and a screen case, wherein the screen case is configured to be slidably mounted within the frame, and wherein the screen case is configured to accommodate filtering material;

wherein the screen case is substantially rectangular having approximately the same dimensions as the radiator and comprises a case back and a case front, wherein the case back is coupled to the case front via a pivot, and wherein the screen case is opened by rotating about the pivot the case front relative to the case back about the pivot.

3. The assembly as recited in claim 2, wherein the case front comprises a front screen, and wherein the case back comprises a back screen.

4. The assembly as recited in claim 3, wherein the front screen has a finer mesh than the back screen.

* * * * *